US005144821A

United States Patent [19]

Ernesti et al.

[11] Patent Number: 5,144,821

[45] Date of Patent: Sep. 8, 1992

[54] PORTABLE LID LOCK

[76] Inventors: Robert M. Ernesti, 123 N. Lincoln; Eugene M. Mueller, 843 N. Lincoln, both of West Point, Nebr. 68788

[21] Appl. No.: 676,878

[22] Filed: Mar. 28, 1991

[51] Int. Cl.[5] ..... E05B 65/06

[52] U.S. Cl. ..... 70/159; 292/DIG. 69; 70/49; 70/14

[58] Field of Search ..... 70/30, 49, 164, 14; 292/DIG. 69

[56] References Cited

U.S. PATENT DOCUMENTS

| | | | |
|---|---|---|---|
| 199,468 | 1/1878 | Rheubottom | 70/49 |
| 911,192 | 2/1909 | Zielenski | 70/32 |
| 2,055,906 | 9/1936 | Menchen | 70/164 |
| 4,171,851 | 10/1979 | Scruggs | 70/258 |
| 4,665,724 | 5/1987 | Sakai | 70/30 |
| 4,756,171 | 7/1988 | Homar | 70/30 |

FOREIGN PATENT DOCUMENTS

| | | | |
|---|---|---|---|
| 818228 | 8/1959 | United Kingdom | 70/30 |

*Primary Examiner*—Renee S. Luebke
*Assistant Examiner*—D. Boucher
*Attorney, Agent, or Firm*—Zarley, McKee, Thomte, Voorhees & Sease

[57] ABSTRACT

A portable lid lock includes a base plate having a rotatable drum mounted thereon from which a cable will extend for extension or retraction upon rotation of the drum. A cover plate has a peripheral depending wall and is connected to the base plate to enclose the drum within a hollow cavity between the cover and base plates. The cable extends through an aperture in the base plate and has a hook connected to the free end thereof. A rotatable handle is mounted on the drum. A cover plate has a peripheral depending wall and is connected to the base plate to enclose the drum within a hollow cavity between the cover and base plates. The cable extends through an aperture in the base plate and has a hook connected to the free end thereof. A rotatable handle is mounted on the cover plate and has a portion extending through an aperture therein to connect to the drum in order to permit selective rotation of the drum. A ratchet gear is mounted on the drum, and a pawl is mounted adjacent thereto to permit rotation in one direction and prevent rotation in the opposite direction. A lock mechanism is mounted to the cover plate and has a throw arm which will selectively disenage the pawl from the ratchet gear to permit free rotation of the drum.

6 Claims, 3 Drawing Sheets

PORTABLE LID LOCK

TECHNICAL FIELD

The present invention relates generally to lock mechanisms, and more particularly to a portable lock which may be utilized in locking the lid of a washer or dryer.

BACKGROUND OF THE INVENTION

One of the main frustrations of apartment dwellers and the like is the task of doing laundry. In particular, the time spent waiting at the washers and dryers is typically very unproductive time. While some patrons will leave their laundry unattended in order to turn their attention to other tasks, these patrons may return to find their laundry missing or removed from the machine by another waiting person.

Another concern of all parents doing laundry is in the potential for a young child to open the washer or dryer while the machine is running.

It is therefore a general object of the present invention to provide a portable lid lock for washers, dryers, and the like.

Another object of the present invention is to provide a lid lock which is easily portable and which may be utilized on various types of appliances to selectively lock the door or lid in the closed position.

A further object is to provide a lid lock which is simple to operate and quick to install and remove.

Yet another object of the present invention is to provide a portable lid lock which is durable for repeated use but light weight.

Still another object of the present invention is to provide a portable lid lock which is economical to manufacture and refine in appearance.

These and other objects will be apparent to those skilled in the art.

SUMMARY OF THE INVENTION

The portable lid lock of the present invention includes a base plate having a rotatable drum mounted thereon from which a cable will extend for extension or retraction upon rotation of the drum. A cover plate has a peripheral depending wall and is connected to the base plate to enclose the drum within a hollow cavity between the cover and base plates. The cable extends through an aperture in the base plate and has a hook connected to the free end thereof. A rotatable handle is mounted on the cover plate and has a portion extending through an aperture therein to connect to the drum in order to permit selective rotation of the drum. A ratchet gear is mounted on the drum, and a pawl is mounted adjacent thereto to permit rotation in one direction and prevent rotation in the opposite direction. A lock mechanism is mounted to the cover plate and has a throw arm which will selectively disengage the pawl from the ratchet gear to permit free rotation of the drum.

DESCRIPTION OF THE PREFERRED EMBODIMENT

Figure 1:
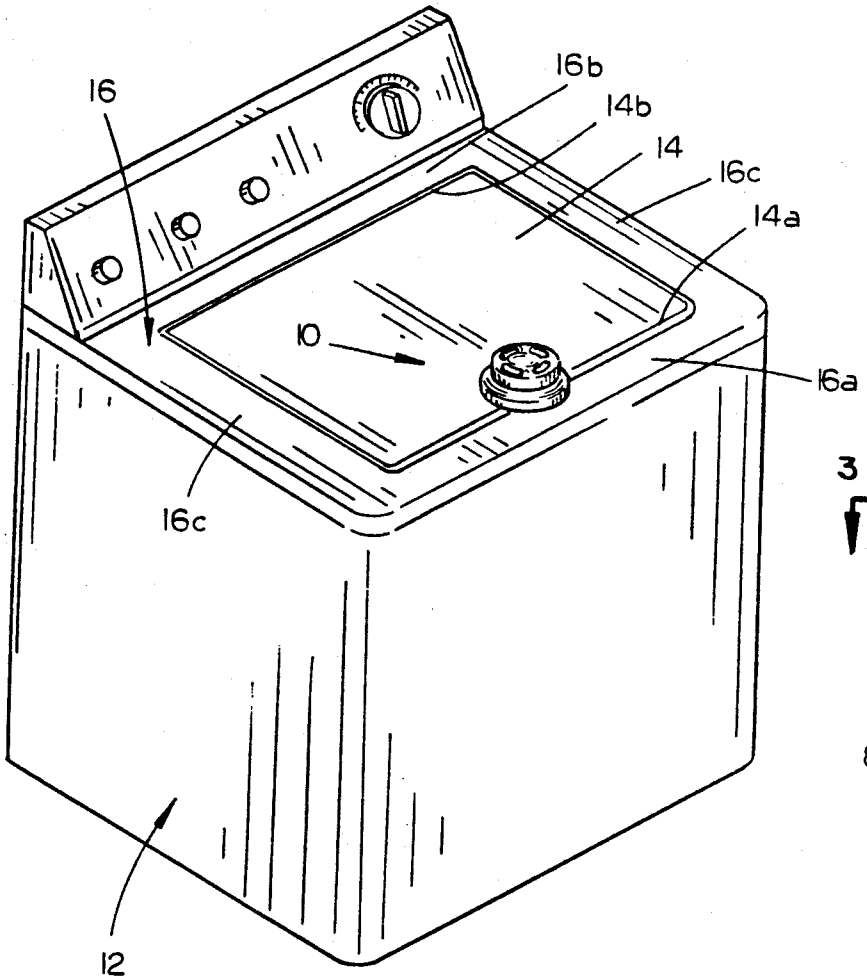
FIG. 1 is a perspective view of a washing machine with the lid lock of the present invention installed thereon.

Referring now to the drawings, in which similar or corresponding parts are identified with the same reference numeral, and more particularly to the FIG. 1, the lid lock of the present invention is designated generally at 10 and is shown installed on a washing machine 12. Washing machine 12 includes a lid 14 having a forward edge 14*a* and rearward edge 14*b*, hinged along its rearward edge 14*b*. The top surface 16 of washer 12 includes a forward ledge 16*a* a rearward ledge 16*b* and opposing side ledges 16*c*. As shown in FIG. 1, lid lock 10 is installed so as to cover the junction between forward edge 14*a* if lid 14 and forward ledge 16*a* of washing machine 12.

Referring now to FIGS. 2 through 5, lid lock 10 includes a generally circular base plate 18 having a peripheral side wall 20 projecting upwardly therefrom. A circular cover plate 22 has a depending side wall 24 and has the same diameter as base plate 18 such that side walls 20 and 24 meet to form a hollow cavity 26 between base plate 18 and cover plate 22 (see FIG. 3). Base plate 18 is connected to cover plate 22 by screws 28 or the like. A rubber pad 30 is mounted to the bottom of base plate 18 to engage the upper surface of the appliance without scratching or otherwise marring the surface of the appliance.

A ratchet gear 32 is rotatably mounted on base plate 18 with a depending cylindrical portion 34 thereof rotatably journaled within a cylindrical depression 36 in the center of base plate 18. A pawl 38 is pivotally mounted on a pin 40 on base plate 18, adjacent and in operable association with ratchet gear 32. Pawl 38 is oriented such that one end 38*a* is in operable engagement with teeth 42 of ratchet gear 32, so as to permit rotation of ratchet gear 32 in one direction but prevent rotation of ratchet gear 32 in the opposite direction when pawl 38 is biased into engagement with the ratchet gear. A leaf spring 44 has one end mounted to a pin 45 on base plate 18 and has its free end 44*a* protecting inwardly therefrom so as to bias pawl 38 into engagement with ratchet gear 32. A V-shaped bracket 47 maintains the opposite end 44*b* of spring 44 on pin 45.

A cylindrical drum 46 projects upwardly from ratchet gear 32, and has a square depression 48 in the upper end thereof. Depression 48 will receive a square peg 50 depending from the bottom of a drum portion 52 affixed to the bottom of a handle 54.

Handle 54 includes a generally disk shaped top plate 56 with a peripheral depending side wall 58. An aperture 60 in cover plate 22 will receive peg 50 and drum portion 52 of handle 54 such that handle side wall 58 forms an annular pocket 62 between top plate 56 and cover plate 22 (shown in FIG. 3). An annular groove 64 and drum portion 52 will receive a locking ring 66, and is located so as to project slightly below cover plate 22 when handle 54 is located on top of plate 22 with drum portion 52 projecting through aperture 60. In this way, locking ring 66 will prevent removal of handle 54 from top plate 22, yet will allow free rotation of handle 54.

An aperture 68 through the diameter of drum portion 52 of handle 54 will receive one end of a flexible cable 70. An enlarged head 72 on the end of cable 70 will prevent withdrawal of the cable from drum portion 52 in one direction. Drum portion 52 on handle 54 is identical in diameter to drum portion 46 on ratchet gear 32, such that insertion of peg 50 within depression 48 will form a single drum when drum portions 46 and 52 abut. In addition, peg 50 will cause ratchet gear 32 to rotate with the rotation of handle 54 such that cable 70 will wrap around drum portions 46 and 52.

Cable 70 extends from drum portion 52 through an aperture 74 in base plate 18 and thence through an aperture 76 in rubber pad 30 and beyond rubber pad 30. A hook member 78 is connected to the lower end of cable 70, and is designed to hook onto a lip 80 on the forward ledge 16*a* of a washing machine 12, as shown in FIGS. 3 and 4.

Figure 5:
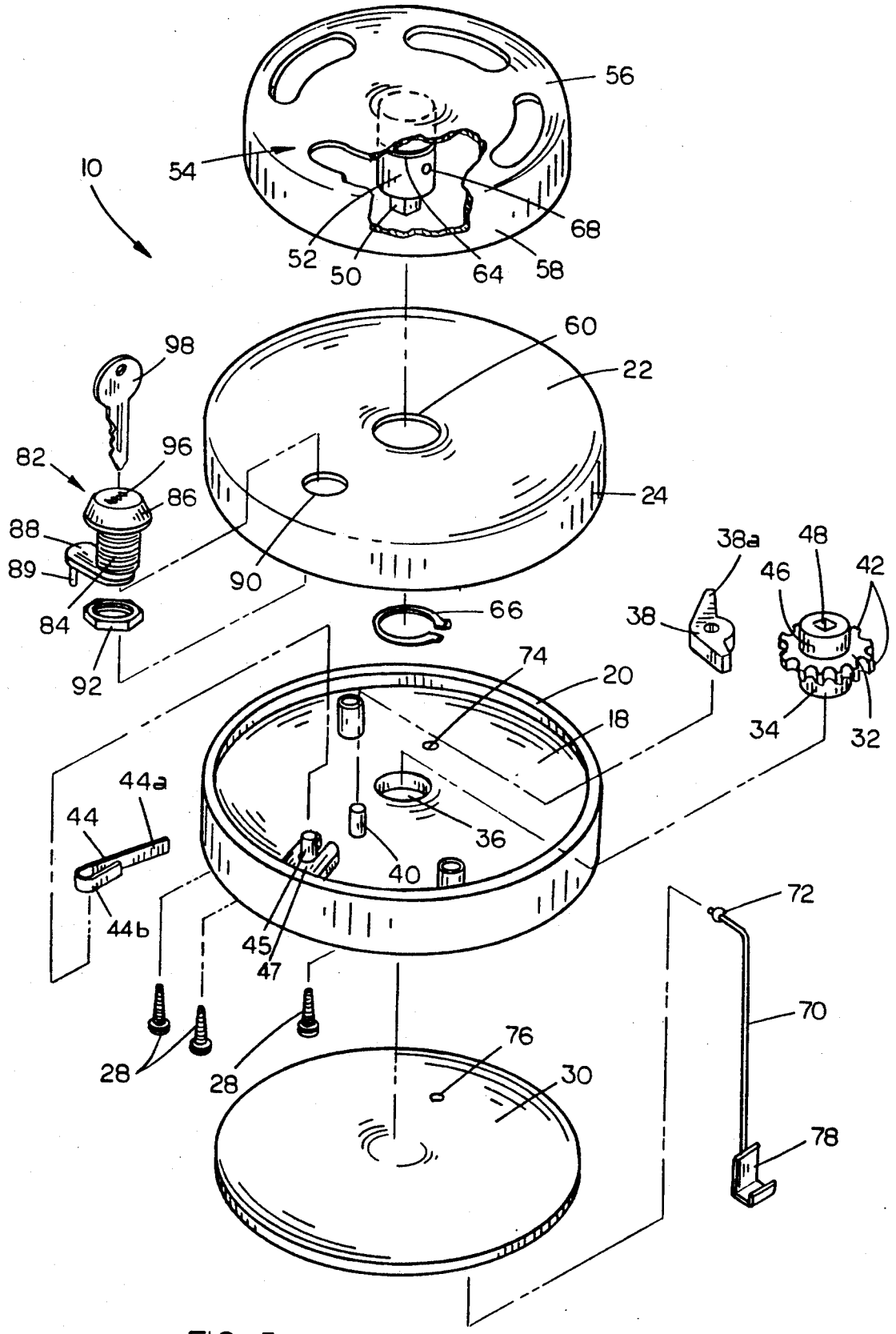
FIG. 5 is an exploded perspective view of the invention.

A lock mechanism 82, is utilized to disengage pawl end 38*a* from ratchet teeth 42 (see the broken-line drawing in FIG. 2) such that ratchet gear 32 may be rotated freely to release hook member 78 from lip 80. As shown in FIG. 5, lock mechanism 82 includes a threaded lock cylinder 84 with an enlarged head 86 and a throw arm 88. A pin 89 depends from throw arm 88. Cylinder 84 is journaled through an opening 90 in cover plate 22 such that throw arm 88 is operable within hollow cavity 26 and head 86 is located within annular pocket 62. A nut 92 fastens lock mechanism 82 in the desired position.

Figure 2:
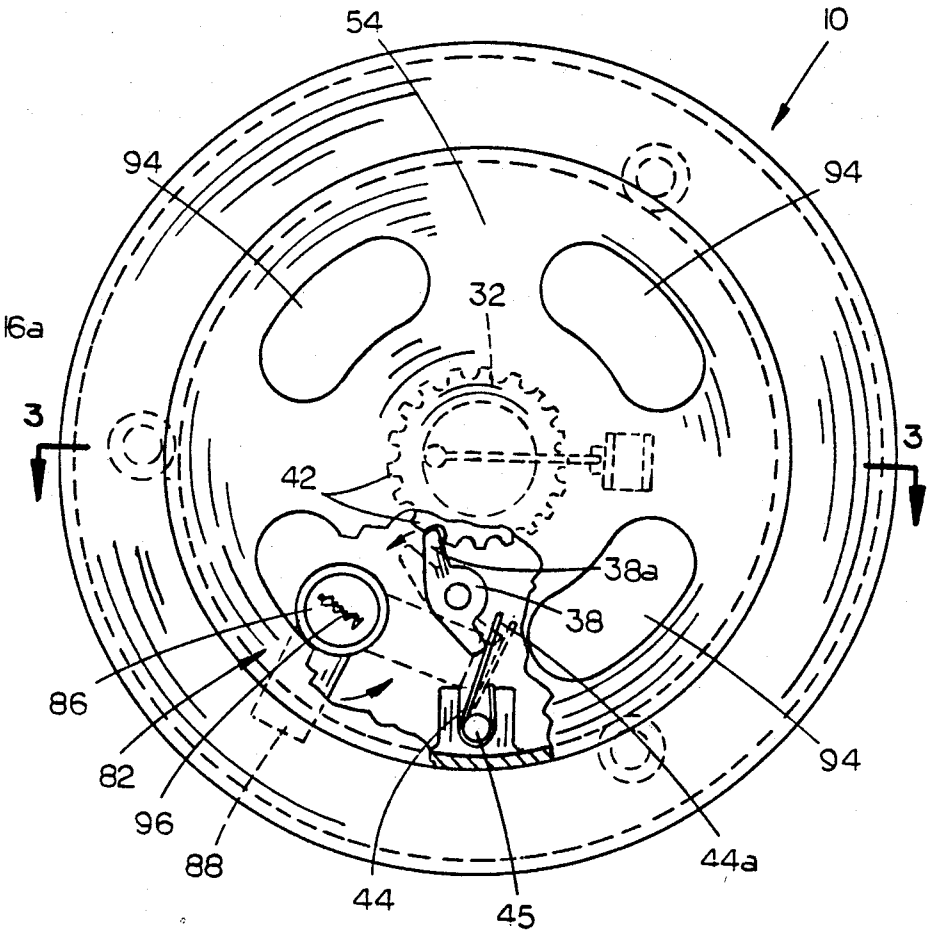
FIG. 2 is a top view of the invention with a portion broken away to show the interior thereof.

As shown in FIG. 2, leaf spring arm 44*a* will bias pawl 38 into engagement with ratchet gear 32 so as to prevent counter-clockwise rotation of ratchet gear 32 and handle 54. Throw arm 88 of lock mechanism 82 may be rotated such that pin 89 pivots pawl 38 to disengage it from teeth 42, as shown in broken lines. This will permit ratchet gear 32 to freely rotate in the counter-clockwise direction. A series of arcuate slots 94 are formed in handle 54 along a circumferential line centered over lock mechanism head 86. Slots 94 permit access to the key slot 96 in lock head 86 by a key 98.

Figure 3:
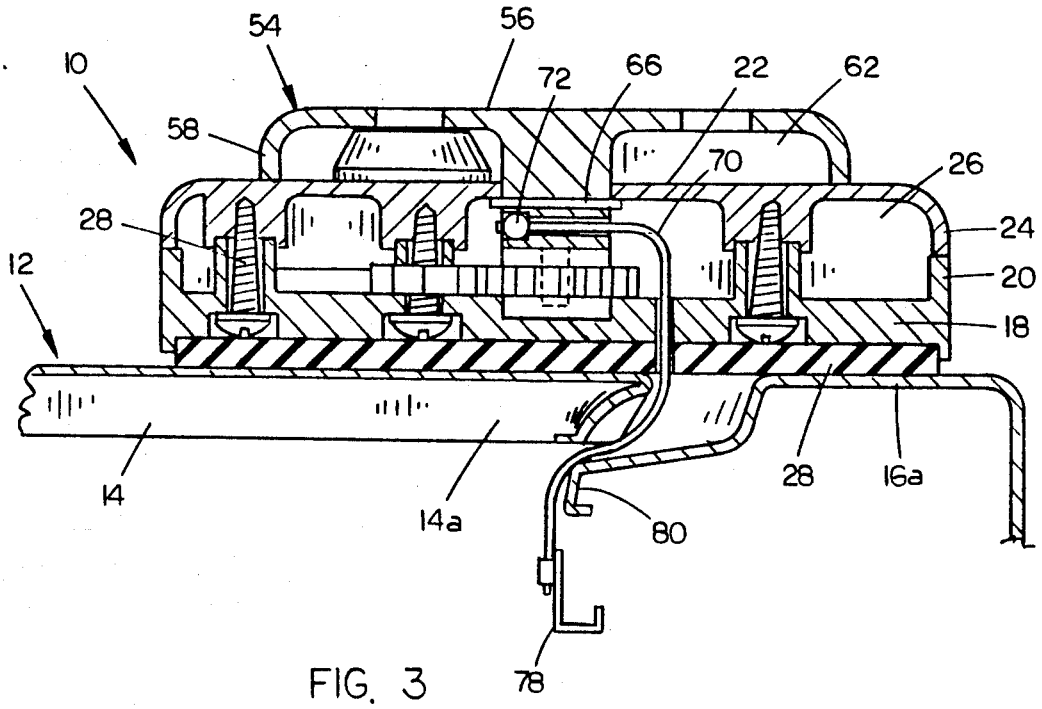
FIG. 3 is a sectional view taken at lines 3—3 in FIG. 2.
Figure 4:
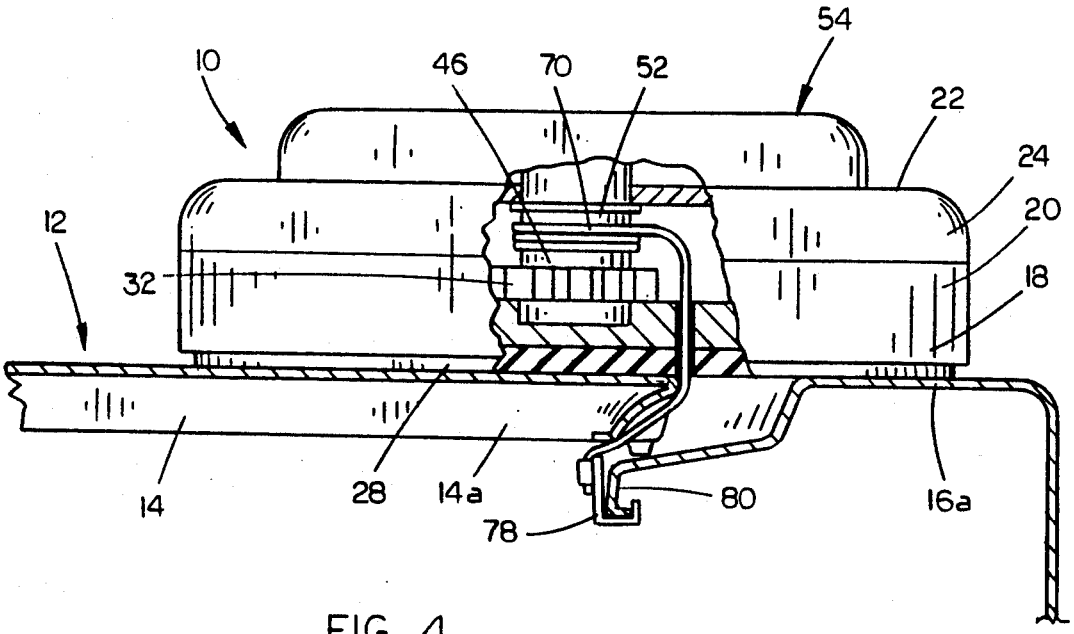
FIG. 4 is side elevational view of the invention similar to FIG. 3, with a portion broken away to show part of the interior of the device.

In operation, cable 70 will initially be extended to its full length as shown in FIG. 3. When it is desired to lock a lid closed on an appliance, such as washing machine 12 of FIG. 1, hook member 78 will be hooked to lip 80 of the ledge 16*a* of the appliance 12. Lid 14 may then be closed and lid lock 10 rested on the top surface of the appliance overlapping lid 14 and ledge 16*a*. Handle 54 is then rotated so as to wrap cable 70 around drum portions 46 and 52, until cable 70 is drawn tight, as shown in FIG. 4. When lock mechanism is in the disengaged or unlocked position, pawl 38 will engage ratchet gear 32, as shown in FIG. 2, to prevent unreeling of cable 70. Thus, lid lock 10 cannot be removed from appliance 12.

When it is desired to remove the lock to access the interior of appliance 12, a key is inserted through one of slots 94 into the key slot 96 in head 86. Throw arm 88 is then rotated such that depending pin 89 engages pawl 38 so as to disengage pawl end 38*a* from ratchet gear 32 to permit cable 70 to be unreeled from drum portions 46 and 52. Lid lock 10 thereby permits locking of an appliance lid, utilizing a light weight, portable and easily utilized apparatus.

Whereas the invention has been shown and described in connection with the preferred embodiments thereof, it will be understood that many modifications, substitutions and additions may be made which are within the intended broad scope of the appendant claims. There has therefore been shown and described a portable lid lock which accomplishes at least all of the above stated objects.

I claim:

1. A portable lid lock, comprising:

a base plate;

a cover plate having a depending peripheral wall;

said cover plate connected to said base plate with said peripheral wall continuously contacting said base plate to form a hollow cavity between said base plate and said cover plate;

a handle means rotatably connected to said cover plate, and having a drum portion extending through an aperture in said cover plate for rotation with said handle and projecting into said hollow cavity between said base plate and said cover plate, said handle rotatable in a first direction to rotate the drum in a first direction and rotatable in a second direction to rotate the drum in a second direction;

retractable cable means having a first end connected to said drum portion and a second end extending through an aperture in said base plate to project generally perpendicularly outwardly from said base plate, said cable first end connected to said drum portion such that rotation of the drum in a first direction extends the cable through said base plate aperture, and such that rotation of the drum portion in a second direction retracts said cable through said base plate aperture;

hook means connected to the second end of said cable; and lock means connected to said cover plate for selectively locking said drum portion to selectively prevent rotation of the drum portion in the first direction so as to prevent extension of said cable.

2. The lid lock of claim 1, wherein said lock means includes:

a ratchet gear mounted on said drum for rotation therewith;

a pawl operably mounted in engagement with said ratchet gear to prevent rotation of the drum in said direction and permit rotation of the drum in the second direction;

a spring mounted to bias said pawl into engagement with said ratchet gear;

a throw arm operably mounted in said hollow cavity and operable between an engaged position wherein the throw arm disengages the pawl from the ratchet to permit rotation of the drum in the first direction, and a disengaged position wherein the throw arm is disengaged from the pawl so as to permit the pawl to engage the ratchet gear.

3. The lid lock of claim 2, further comprising a lock mechanism connected to said throw arm for selective movement of the throw arm between the engaged and disengaged positions.

4. The lid lock of claim 3, wherein said lock mechanism includes:

a lock cylinder with an enlarged head portion at an upper end and said throw arm connected at the lower end thereof;

said lock cylinder extending through an opening in said cover plate with the head portion located above the cover plate and the throw arm located within said hollow cavity.

5. The lid lock of claim 4, wherein said handle means includes a generally disk shaped top plate with a peripheral depending side wall so as to form an annular pocket between said top plate and said cover plate.

6. The lid lock of claim 5, wherein said lock cylinder head is positioned in said annular pocket, and wherein said top plate has at least one slot formed therein permitting access to said lock cylinder head.

* * * * *